US010964211B2

(12) United States Patent
Kurehashi

(10) Patent No.: US 10,964,211 B2
(45) Date of Patent: Mar. 30, 2021

(54) VEHICLE DRIVING ASSISTANCE DEVICE, DRIVING INFORMATION DELIVERY SYSTEM, AND DRIVING INFORMATION DELIVERY METHOD

(71) Applicant: HONDA MOTOR CO., LTD., Tokyo (JP)

(72) Inventor: Takahiro Kurehashi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/832,496

(22) Filed: Mar. 27, 2020

(65) Prior Publication Data

US 2020/0312140 A1 Oct. 1, 2020

(30) Foreign Application Priority Data

Mar. 29, 2019 (JP) ..... JP2019-065529

(51) Int. Cl.

| | |
|---|---|
| ***G08G 1/09*** | (2006.01) |
| ***G08G 1/0967*** | (2006.01) |
| ***G08G 1/083*** | (2006.01) |
| ***G08G 1/052*** | (2006.01) |
| ***G08G 1/01*** | (2006.01) |

(52) U.S. Cl.

CPC ..... *G08G 1/096716* (2013.01); *G08G 1/0116* (2013.01); *G08G 1/052* (2013.01); *G08G 1/083* (2013.01)

(58) Field of Classification Search

CPC ..... G08G 1/0116

USPC ..... 340/905, 907, 932.2, 998, 995

See application file for complete search history.

(56) References Cited

U.S. PATENT DOCUMENTS

2013/0253750 A1* 9/2013 Otake ..... B60W 30/18127 701/22
2016/0180710 A1* 6/2016 Maeda ..... G08G 1/096741 340/932
2019/0184976 A1* 6/2019 Kim ..... B60W 20/12

FOREIGN PATENT DOCUMENTS

JP 2011-090379 A 5/2011

* cited by examiner

*Primary Examiner* — Tai T Nguyen
(74) *Attorney, Agent, or Firm* — Rankin, Hill & Clark LLP

(57) ABSTRACT

A vehicle driving assistance device includes a driving assistance controller and an acquisition portion. The driving assistance controller includes a signal information acquisition part, a remaining distance calculator, and a driving assistance information output portion. The acquisition portion acquires information on (i) a vehicular speed and remaining distance to the intersection of an intersecting-side vehicle travelling on an intersecting road that joins a main road at the intersection, (ii) an arrival time when the intersecting-side vehicle arrives at the intersection, or (iii) lighting period information of an intersecting-side traffic signal. The driving assistance controller updates lighting period information of a main-side traffic signal based on information acquired from a road-to-vehicle communication transceiver, and outputs driving assistance information based on the updated lighting period information.

9 Claims, 7 Drawing Sheets

VEHICLE DRIVING ASSISTANCE DEVICE, DRIVING INFORMATION DELIVERY SYSTEM, AND DRIVING INFORMATION DELIVERY METHOD

CROSS-REFERENCE TO RELATED APPLICATIONS

This application is based upon and claims the benefit of priority from Japanese Patent Application No. 2019-065529 filed Mar. 29, 2019, the entire contents of which are incorporated herein by reference.

TECHNICAL FIELD

This disclosure is related to a vehicle driving assistance device, driving information delivery system, and driving information delivery method that enable a driver to be notified of driving assistance information for a signalized intersection.

BACKGROUND ART

Recent years have seen a rise in vehicles and in-vehicle devices that are equipped with traffic signal prediction systems (TSPS) that can provide drivers with information that assist in their driving. Through TSPS, a vehicle heading towards a signalized intersection is able to receive information on the traffic signal ahead, including the current color light, the length of time each color light is indicated, and the remaining time until the indication changes to the next color light (the remaining time, the wait time). Using this signal information and the time the vehicle takes to reach the intersection (calculated from the vehicle's speed and location), the vehicle's driver is provided with notifications regarding information that assist in the smooth navigation of the intersection, such as assistance on proceeding through the intersection while following the traffic signal (hereinafter "proceed-through-signal assistance") or assistance on decelerating at a red light (hereinafter "red-light assistance").

On roads where TSPS is available, there may be intersections where a main road (which forms the main-road side of the intersection) is joined by a subsidiary road (which forms the intersecting-road side of the intersection) and where there is significant difference in the amount of traffic between the two roads. At such intersections, semi-actuated traffic signals (hereinafter an "actuated traffic signal" and "actuated traffic signals") may be installed so that the traffic signals are activated whenever there is a vehicle at the intersection on the intersecting-road side, causing a traffic signal on the intersecting-road side to turn to a green light. The presence of the vehicle on the subsidiary road is detected by a vehicle detector on the subsidiary road.

Patent literature 1 (Japanese Unexamined Patent Application Publication No. 2011-090379) describes a technology for reporting a vehicle's wait time when the vehicle stops at an actuated traffic signal.

SUMMARY

Although the technology described in patent literature 1 is beneficial for vehicles travelling on subsidiary roads, the same cannot be said for vehicles travelling on main roads. Due to an alteration in the lighting times of color lights (hereinafter "lighting times") of an upcoming intersection's traffic signal (resulting in an alteration in the remaining time of an indicated color light), a change may have to be made to the content of assistance information such as for red-light assistance and proceed-through-signal assistance derived using signal information from an optical beacon. Worse still, the provision of assistance information may have to be terminated. Such actions may lead to drivers finding the TSPS assistance information distracting.

The object, therefore, is to provide a vehicle driving assistance device, driving information delivery system, and a driving information delivery method that are capable of supplying information that assist a driver in driving through an intersection without being distracting, even when the intersection is installed with actuated traffic signals.

The embodiment describes a vehicle driving assistance device for outputting information that assists an assisted vehicle to pass through an intersection installed with actuated traffic signals. The vehicle driving assistance device includes a driving assistance controller and an acquisition portion. The driving assistance controller includes a signal information acquisition part, a remaining distance calculator, and a driving assistance information output portion. The signal information acquisition part acquires lighting period information of an actuated traffic signal on a main-road side of the intersection. The remaining distance calculator obtains a remaining distance to the intersection of the assisted vehicle. The driving assistance information output portion outputs driving assistance information derived from the lighting period information and the remaining distance. The acquisition portion acquires intersecting-road side information of the intersection where a main road is joined by an intersecting road, the intersecting-road-side information being (a) information on a vehicular speed and a remaining distance to the intersection of an intersecting-side vehicle travelling towards the intersection on the intersecting road, (b) an arrival time of the intersecting-side vehicle at the intersection, or (c) lighting period information of an actuated traffic signal on an intersecting-road side of the intersection. The driving assistance controller (i) updates the lighting period information of the actuated traffic signal on the main-road side of the intersection based on information acquired from the acquisition portion, and (ii) outputs driving assistance information through the driving assistance information output portion based on the updated lighting period information.

According to a vehicle driving assistance device, a driving information delivery system, and a driving information delivery method of the disclosure, even when a vehicle approaches an intersection installed with actuated traffic signals, because driving assistance is provided based on knowledge of any forthcoming activation process of the actuated traffic signals, driving assistance may be provided without disruption.

BRIEF DESCRIPTION OF THE DRAWINGS

The disclosure will become more fully understood from the following detailed description, taken in conjunction with the accompanying figures, in which.

DETAILED DESCRIPTION OF EMBODIMENTS

Details of embodiments of the present disclosure will be given with reference to figures.

Figure 1:
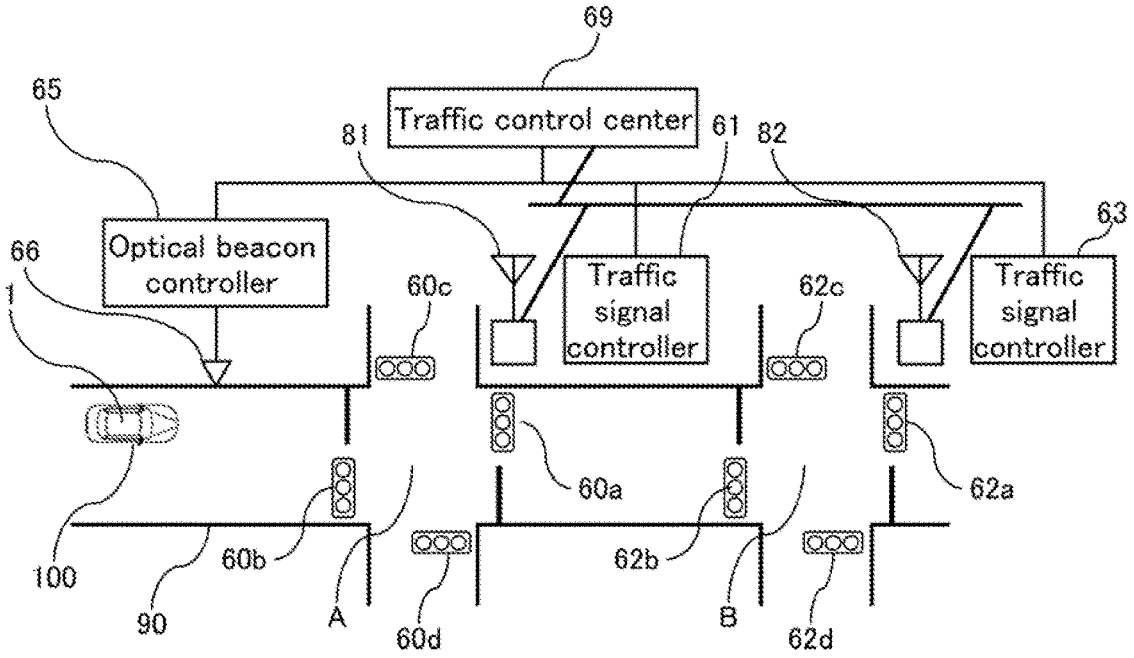
FIG. 1 is a schematic view of the Driving Safety Support Systems (DSSS).
Figure 2:
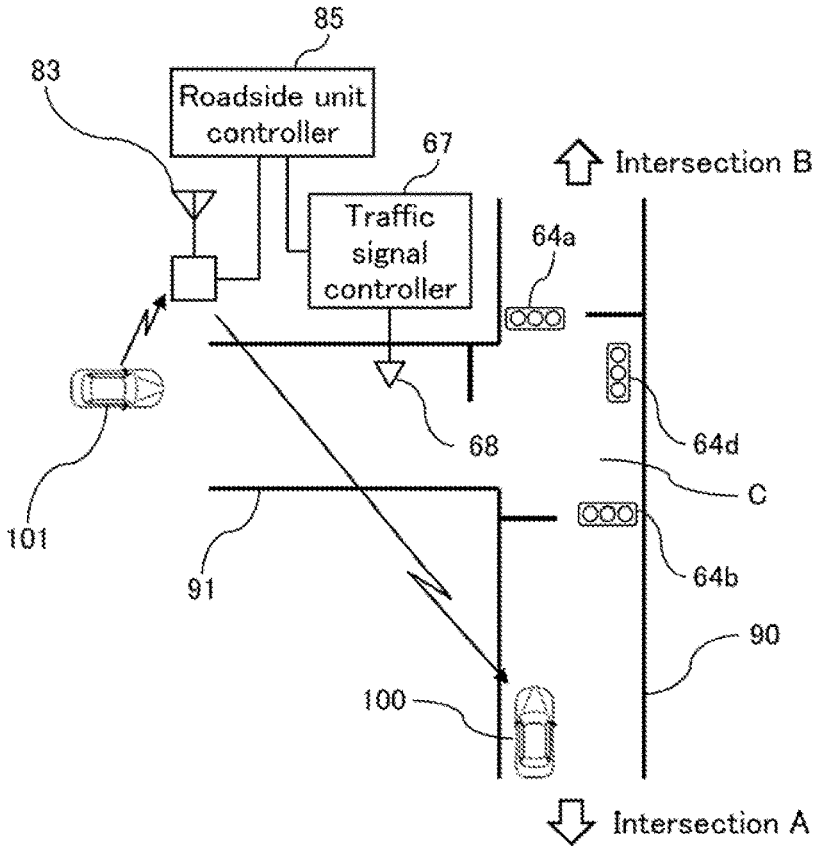
FIG. 2 is a schematic view of an intersection with actuated traffic signals.

Note that although the illustrations depicted in FIG. 1 and FIG. 2 are based on left-hand traffic, the embodiments and teachings herein are also applicable to right-hand traffic. Those skilled in the art will, in light of the present disclosure, be able to apply the teachings herein to right-hand traffic.

First, a roadside infrastructure that forms the basis of an operation of a vehicle driving assistance device 1 of the embodiment will be explained using FIG. 1.

FIG. 1 is a schematic diagram illustrating the Driving Safety Support Systems (DSSS). A vehicle 100 installed with a vehicle driving assistance device 1 is travelling along a road 90 from the left of the figure to the right. The road 90 has two intersections, intersection A and intersection B. (Note that a vehicle that is installed with a vehicle driving assistance device 1 according to an embodiment is also referred to herein as an "assisted vehicle".)

Intersection A is installed with traffic signals 60*a*, 60*b*, 60*c*, and 60*d* whose lighting times are controlled by a traffic signal controller 61. Intersection B is installed with traffic signals 62*a*, 62*b*, 62*c*, and 62*d* whose lighting times are controlled by a traffic signal controller 63.

Traffic signal controllers 61 and 63 are connected to a traffic control center 69. The traffic signal controllers 61 and 63 control the turning on and turning off of each aspect that make up the corresponding traffic signals based on signal indication information, where the signal indication information includes control information concerning a length of time each aspect is illuminated (hereinafter a "lighting period") for the corresponding traffic signals (60*a*, 60*b*, 60*c*, and 60*d*, or 62*a*, 62*b*, 62*c*, and 62*d*) as set by the traffic control center 69. (Note that an optical unit of a traffic signal that indicates a red, a green, or an amber light when illuminated is referred to herein as an "aspect". Note also that information on the lighting periods of aspects of a traffic signal is hereinafter referred to as "lighting period information" of a traffic signal.)

This signal indication information of each traffic signal is notified as road signal information by the traffic control center 69 to an optical beacon controller 65.

An optical beacon 66, set up on road 90 upstream of traffic signals 60*a* and 62*a*, is a wireless communication device that is controlled by an optical beacon controller 65. The optical beacon 66 sends and receives information to and from vehicle 100 that travels through the intersections with traffic signals 60*a* and 62*a*.

In addition to road signal information, which includes individual signal indication information of traffic signals set up at intersections along the road 90 on which the vehicle 100 travels, the optical beacon 66 notifies the vehicle 100 of road shape information that includes the shape and stop line position of each of the intersections.

The vehicle driving assistance device 1 of the embodiment may, instead of acquiring road signal information and road shape information via the near-infrared optical beacon 66, use dedicated short-range communications (DSRC) in the 5.8 GHz band to acquire road signal information and road shape information.

Alternatively, the vehicle driving assistance device 1 may acquire road signal information and road shape information from the traffic control center 69 via roadside units 81 and 82 (wireless base stations) by using road-to-vehicle communication based on a wireless communication system as standardized by the 700 MHz Band Intelligent Transport Systems (ARIB STD-T109).

Alternatively, the vehicle driving assistance device 1 may use a portable radio communication device to notify the traffic control center 69 of any one of the following information to acquire the corresponding road signal information and road shape information: (a) information on the location of vehicle 100, (b) the identification number of an intersection, or (c) information on the location of an intersection (latitude and longitude information).

The vehicle driving assistance device 1 forms a traffic signal utilization system that provides a driver with driving assistance information based on information on the position and speed of a vehicle 100 as well as on the abovementioned road signal information (lighting period information of a traffic signal) and road shape information (e.g., the shape of an intersection, the stop line position of an intersection) that are delivered through a driving information delivery system.

FIG. 2 shows a schematic view of intersection C set up with actuated traffic signals. Intersection C is located on road 90 between intersections A and B shown in FIG. 1. In FIG. 2, road 90 is laid out vertically, and vehicle 100, after having passed through intersection A, enters intersection C from below and comes out from above in the direction of intersection B.

Intersection C is a T junction where road 91 (an intersecting road) with light traffic connects to road 90 (a main road) with heavy traffic.

Due to the difference in traffic volume, intersection C is installed with actuated traffic signals 64*a*, 64*b*, and 64*d*.

A vehicle detector 68 is set up above ground at a stop line on road 91 at intersection C. The vehicle detector 68 detects a vehicle 101 that stops at the stop line and sends a detection signal to a traffic signal controller 67.

Based on an incoming detection signal from the vehicle detector 68, the traffic signal controller 67 controls the traffic signal 64*a*, 64*b*, and 64*d* so that the traffic signal 64*d*, which normally rests with a red light, changes to a green light and the traffic signals 64*a* and 64*b*, which normally rests with a green light, change to a red light. In this way, a vehicle 101 on road 91 can enter road 90.

Furthermore, a roadside unit 83 (a wireless base station) that is set up at intersection C connects to a roadside unit controller 85 and carries out road-to-vehicle communication with vehicles close to the intersection, namely vehicle 100 and vehicle 101. The vehicle driving assistance device 1 of the embodiment notifies, via the roadside unit 83, information such as vehicular speed and distance to the intersection to either the roadside unit controller 85 or the traffic control center 69 (details are given later). In this way, the approaching of vehicle 101 on road 91 (the intersecting road) can be perceived earlier than can be detected by the vehicle detector 68.

In addition to managing the information of a vehicle 101 on road 91, the roadside unit controller 85 controls the communication between vehicles travelling on road 90 and road 91 through controlling the roadside unit 83, thereby carrying out virtual vehicle-to-vehicle communication.

Although the roadside unit controller 85 of FIG. 2 is shown as a part of roadside infrastructure, the roadside unit controller 85 may be realized as one of the server functions of the traffic control center 69.

Figure 3:
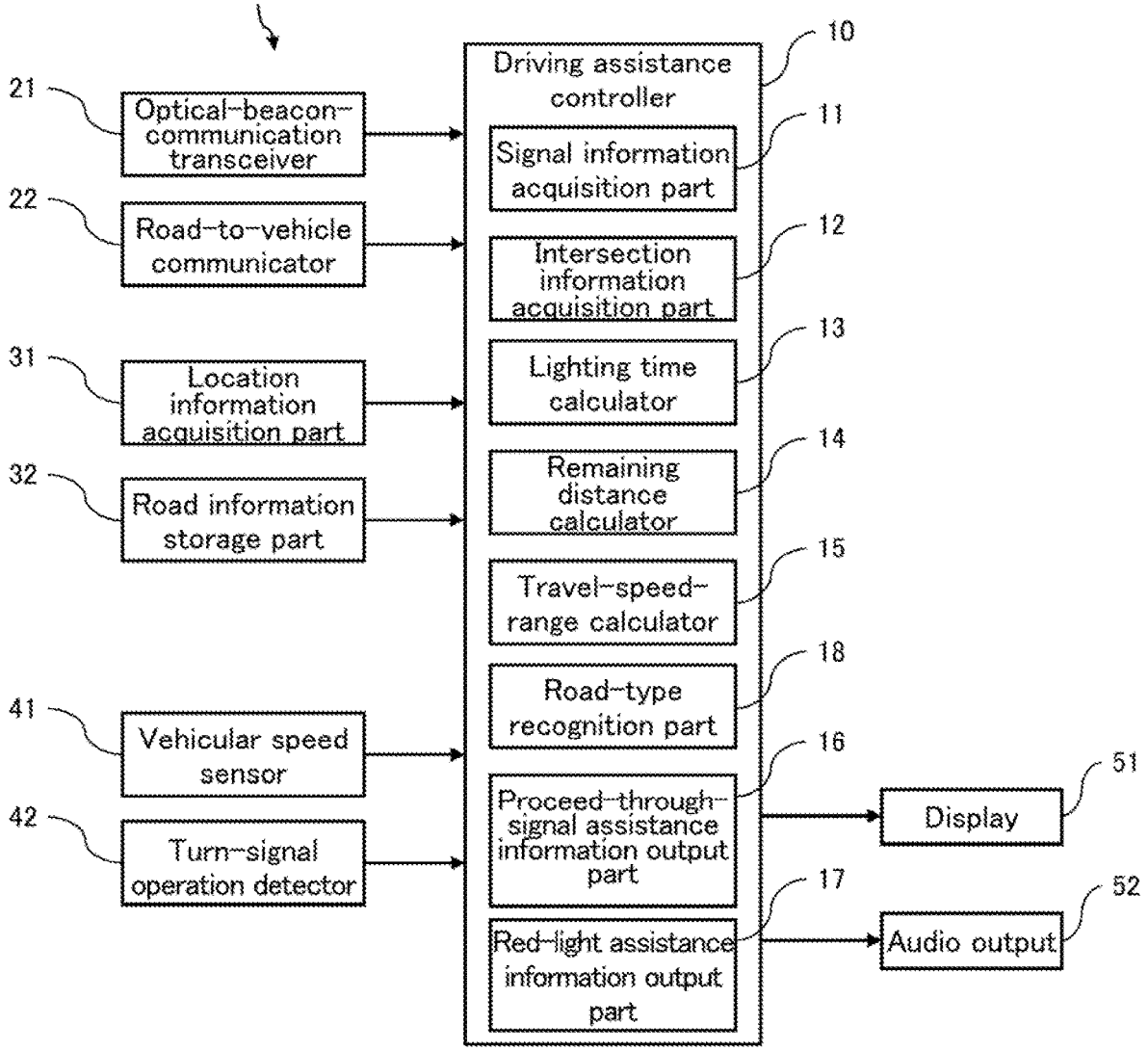
FIG. 3 is a diagram illustrating the configuration of a vehicle driving assistance device.

FIG. 3 is a block diagram of the vehicle driving assistance device 1.

An optical-beacon-communication transceiver 21 is a near-infrared communication portion that acquires road signal information and road shape information from an optical beacon 66 (see FIG. 1) and notifies a vehicle ID and trip time to the optical beacon 66.

A road-to-vehicle communication transceiver 22 (an acquisition portion) is a communication portion that uses 700 MHz band wireless communication to send and receive information such as vehicle information (such as vehicular speed and vehicle location), road signal information, and road shape information to and from roadside units 81, 82, and 83 at intersections A, B, and C.

A location information acquisition part 31 is a processing part for acquiring location information of a vehicle such as location information from the Global Positioning System (GPS).

A road information storage part 32 is a storage part where information such as road map information, an intersection shape, and stop line location information are stored. For example, the road information storage part 32 may store map information acquired from a navigation device, or store information acquired via the optical-beacon-communication transceiver 21 or road-to-vehicle communication transceiver 22.

A vehicular speed sensor 41 detects the travelling speed of a vehicle.

A turn-signal operation detector 42 detects an instruction to operate a turn signal to indicate a left or right turn at an intersection.

A display 51 is used to inform a driver of vehicle 100 of the range of speed within which the vehicle 100 may pass through an intersection ahead at a green light. The display 51 is also used to provide guidance on working the accelerator so that the vehicle 100 may come to a stop at the stop line of an intersection at a red light without unnecessary deceleration nor acceleration.

An audio output 52 outputs, for example, an alarm or a voice message to let the driver become aware of driving assistance information that is provided such as for assisting the driver to proceed through an intersection while following the traffic signal (hereinafter "proceed-through-signal assistance") or for assisting the driver to decelerate at a red light (hereinafter "red-light assistance").

A driving assistance controller 10 is an information processor that comprises a microcomputer, an input, and an output. By running a program that is stored in a built-in memory, a signal information acquisition part 11, an intersection information acquisition part 12, a lighting time calculator 13, a remaining distance calculator 14, a travel-speed-range calculator 15, a proceed-through-signal assistance information output part 16 (a driving assistance information output portion), a red-light assistance information output part 17 (a driving assistance information output portion), and a road-type recognition part 18 function as processing parts (details are provided later).

Although in FIG. 3, the vehicle driving assistance device 1 according to an embodiment of the present invention is configured to be equipped with both an optical-beacon-communication transceiver 21 and a road-to-vehicle communication transceiver 22, having either one will suffice as long as road signal information and road shape information can be acquired.

Alternatively, the vehicle driving assistance device 1 may be equipped with a DSRC transceiver instead of an optical-beacon-communication transceiver 21 or a road-to-vehicle communication transceiver 22.

The vehicle driving assistance device 1 according to an embodiment of the present invention may be embedded within a vehicle's driving assistance ECU (electronic control unit) or car navigation system.

Figure 4:
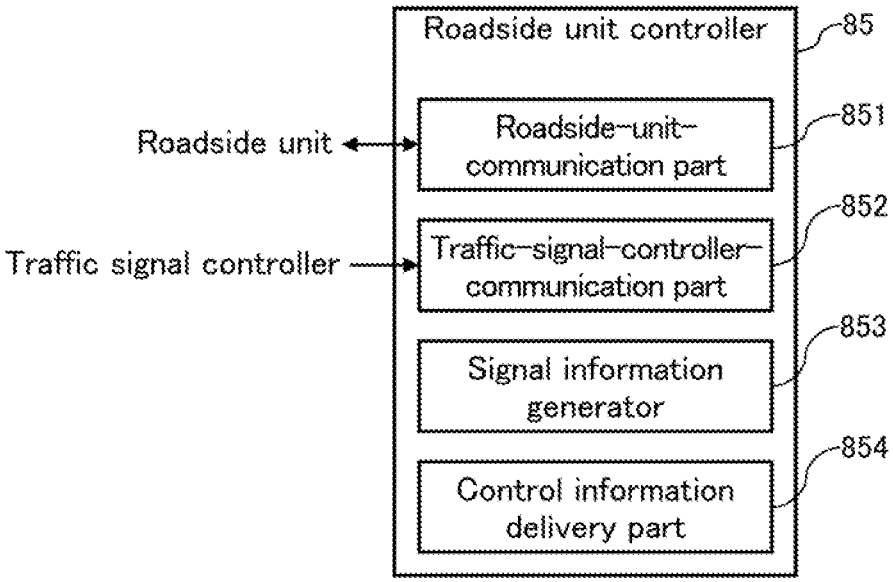
FIG. 4 is a diagram illustrating the configuration of a roadside unit controller.

FIG. 4 is a diagram illustrating the configuration of a roadside unit controller 85. The roadside unit controller 85 is an information processor that includes a microcomputer, an input, and an output. By running a program that is stored in a built-in memory, a roadside-unit-communication part 851, a signal-controller-communication part 852, a signal information generator 853, and a control information delivery part 854 function as processing parts.

The roadside-unit-communication part 851 is a processing part that sets up a connection with a roadside unit 83 and carries out communication with vehicle 100 and vehicle 101 that are close to intersection C via the roadside unit 83. The roadside-unit-communication part 851 sends road shape information to vehicle 101 travelling on road 91 (an intersecting-side vehicle). The road shape information sent is either information on the location of a stop line at intersection C or information on the location of intersection C. Furthermore, the roadside-unit-communication part 851 receives information on vehicular speed, information on a distance to the intersection, arrival time at the intersection, or signal indication information from the intersecting-side vehicle. Furthermore, the roadside-unit-communication part 851 sends information on vehicular speed, information on a distance to the intersection, arrival time at the intersection, or signal indication information of the intersecting-side vehicle to vehicle 100 travelling on road 90 (a main-side vehicle). (Details are given later.)

The traffic-signal-controller-communication part 852 acquires signal indication information of traffic signals 64*a*, 64*b* and 64*d* as road signal information from traffic signal controller 67. The traffic-signal-controller-communication part 852 also sends the traffic signal controller 67 information for controlling the activation process of actuated traffic signals 64*a*, 64*b*, 64*d*.

The signal information generator 853 is a processing part that either generates signal indication information of a traffic signal or calculates the arrival time of an intersection-side vehicle at an intersection based on information from the intersecting-side vehicle that is acquired from the roadside-unit-communication part 851.

The control information delivery part 854 controls the road-to-vehicle communication with an intersecting-side vehicle or a main-side vehicle through controlling either the roadside-unit-communication part 851 or traffic-signal-controller-communication part 852.

The operation of the roadside unit controller 85 is explained in further detail later with FIG. 7A, 7B, and 7C.

Figure 5:
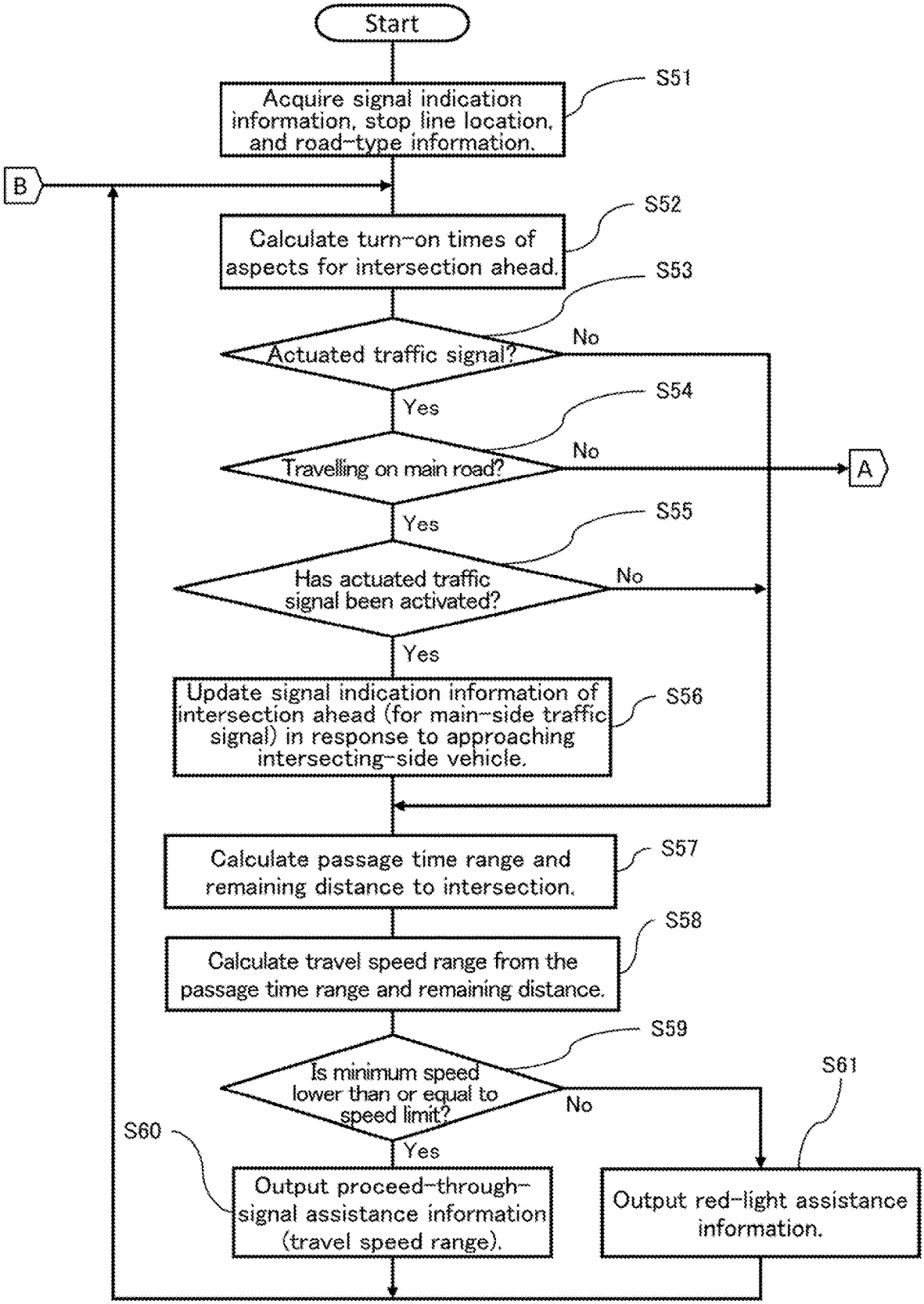
FIG. 5 is a flow chart of the overall process performed by a driving assistance controller, also showing the steps involved when a vehicle is travelling on a main road (a main-side vehicle).
Figure 6:
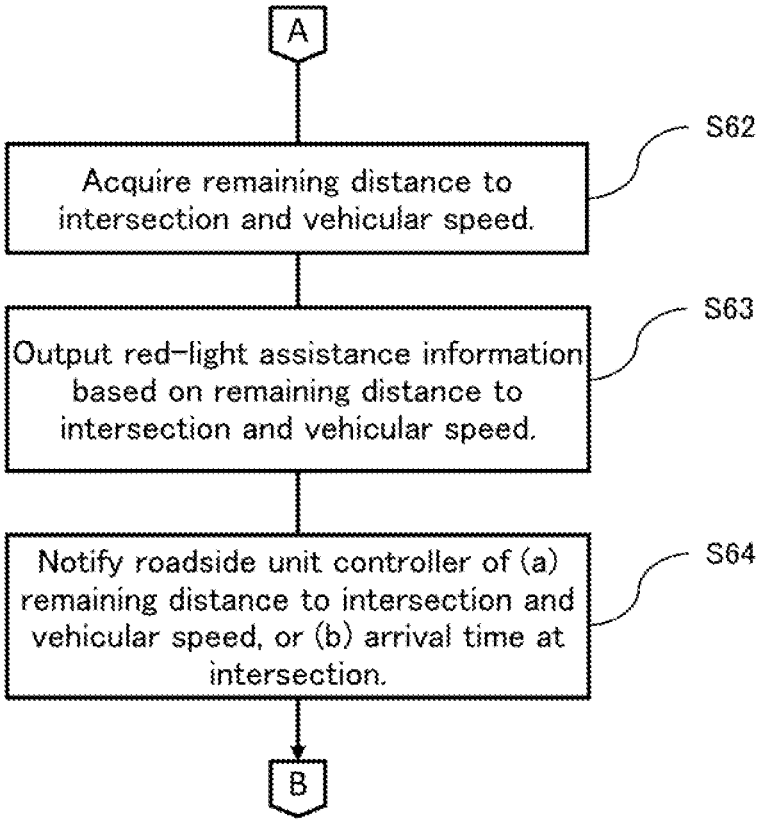
FIG. 6 is a flow chart showing the steps involved when a vehicle is travelling on an intersecting road (an intersecting-side vehicle).

Next, the functions of the driving assistance controller 10 are explained in detail using FIG. 5 and FIG. 6. One function that the vehicle driving assistance device 1 of the embodiment has is to output driving assistance information for a vehicle when that vehicle is travelling on road 90 as a main-side vehicle. Another function is to output driving assistance information for a vehicle when that vehicle is travelling on road 91 as an intersecting-side vehicle.

First, the overall process performed by the driving assistance controller 10 and the steps performed as a main-side vehicle is explained using FIG. 5.

In step S51, the signal information acquisition part 11 of the driving assistance controller 10 acquires road signal information that includes lighting control information of the traffic signal 64*a* and other traffic signals either via the optical-beacon-communication transceiver 21 or road-to-vehicle communication transceiver 22. Furthermore, the intersection information acquisition part 12 of the driving assistance controller 10 acquires road shape information that includes information on the location of a stop line and a road type (for example, a main road) either via the optical-beacon-communication transceiver 21 or via the road-to-vehicle communication transceiver 22. Alternatively, the intersection information acquisition part 12 acquires road shape information from the road information storage part 32. In short, in step 51, signal indication information, a stop line location, and road-type information are acquired.

In step 52, the lighting time calculator 13 of the driving assistance controller 10 derives the cycle length of a traffic signal from a lighting period within a lighting pattern of each aspect, based on the lighting control information acquired from the signal information acquisition part 11 (the cycle length is the sum of the lighting period within the lighting pattern of each aspect), and calculates the turn-on time of each aspect of the intersection ahead for which driving assistance information is output, the turn-on times calculated from the acquisition time of the road signal information, the color of the traffic signal illuminated at the acquisition time, and the time remaining until the color changes.

In the case of intersection C where the traffic signals are semi-actuated, the turn-on time of each aspect is calculated for traffic signals 64*a* and 64*b* of road 90 (the main-road side of the intersection) when the traffic signals rest on a green light, and the turn-on time of each aspect is calculated for traffic signal 64*d* when the traffic signal rests on a red light.

In step S53, the road-type recognition part 18 of the driving assistance controller 10 decides whether the traffic signal at the intersection, for which assistance information for passing through the intersection is output, is an actuated traffic signal or not. The road-type recognition part 18 makes the decision from information such as the turn-on time of each aspect calculated in step S52 and traffic signal type information contained in road signal information. If the traffic signal is an actuated traffic signal ("Yes" in S53), then the process advances to step S54, and if not ("No" in S53), to step S57.

In step S54, the road-type recognition part 18 of the driving assistance controller 10 refers to information such as road map information or road shape information (road-type information) to identify the road that coincides with the assisted vehicle's location in order to determine whether the assisted vehicle is travelling on a main road or not. Note that the assisted vehicle's location is obtained from the location information acquisition part 31. If the assisted vehicle is travelling on a main road, the process advances to step S55, and if not, to a sequence of steps shown in FIG. 6.

The flow chart of FIG. 6 describes the steps the driving assistance controller 10 carries out when the intersection ahead has actuated traffic signals and the assisted vehicle is travelling on a road that is not a main road (in other words, an intersecting road).

In step S55, the driving assistance controller 10 determines whether the actuated traffic signals are activated. If activated ("Yes" in S55), then the process advances to step S56, and if not ("No" in S55), to step S57.

To elaborate, the driving assistance controller 10 determines whether the actuated traffic signals are activated or not based on whether or not there is notification from the roadside unit 83 at intersection C on any of the following information: (i) information on a vehicular speed and a remaining distance to the intersection of an intersecting-side vehicle, (ii) an arrival time at the intersection of an intersecting-side vehicle, or (iii) signal indication information that indicates the time when an intersecting-side traffic signal changes to a green light.

In step 56, the lighting time calculator 13 updates the signal indication information that indicates the turn-on times of individual aspects at the intersection ahead for which driving assistance information is output (which was calculated in step S52). In other words, the signal indication information of the main-side traffic signal that has been resting on a green light is updated so that in the updated signal indication information, the main-side traffic signal changes from a green light to an amber light at a specific time, followed by a red light that is indicated for a certain period of time.

To elaborate, if notification came in the form of an intersecting-side vehicle's information on a vehicular speed and a remaining distance to an intersection stop line, the lighting time calculator 13 calculates the intersecting-side vehicle's approach time, the approach time being the time taken for the intersecting-side vehicle to travel the remaining distance by decelerating from the notified speed at a specific rate and stopping at the stop line. The arrival time of the intersecting-side vehicle at the stop line is then calculated by adding this approach time to a notification time, where the notification time is the time when information on the vehicular speed and the remaining distance was notified by the intersecting-side vehicle.

Alternatively, the lighting time calculator 13 may, on the assumption that a function to provide red-light assistance information is in operation on the intersecting-side vehicle, determine the intersecting-side vehicle's approach time based on a speed pattern that is output as the red-light assistance information.

Furthermore in step S56, the lighting time calculator 13 derives the time when the intersecting-side traffic signal changes to a green light (the turn-on time of a green light) by adding a specific activation period of the actuated traffic signals to the calculated arrival time of the intersecting-side vehicle. The lighting time calculator 13 determines this green light turn-on time to be the signal indication information of the intersecting-side traffic signal.

Later in step S56, the lighting time calculator 13 derives the lighting information of the main-side traffic signal that corresponds to the signal indication information of the intersecting-side traffic signal. The derived lighting information includes when the main-side traffic signal changes to a red light, which is the same as the time when the intersecting-side traffic signal changes to a green light, and when the main-side traffic signal changes to an amber light, which is at a specific period of time prior to when the main-side traffic signal changes to a red light. The lighting time calculator 13 determines this lighting information to be the signal indication information of the main-side traffic signal. The process then advances to step S57.

Alternatively, if, in step S56, notification came in the form of an arrival time of an intersecting vehicle at the intersection, the lighting time calculator 13 derives the turn-on time of a green light for the intersecting-side traffic signal by adding a specific activation period of the actuated traffic signals as above. The lighting time calculator 13 determines this green light turn-on time to be the signal indication information of the intersecting-side traffic signal. The signal indication information of the main-side traffic signal is then derived from the signal indication information of the intersecting-side traffic signal. The process then advances to step S57.

Alternatively, if, in step S56, notification came in the form of signal indication information of an intersecting-side traffic signal, the lighting time calculator 13 derives the signal indication information of the main-side traffic signal based on the signal indication information of the intersecting-side traffic signal as above. The process then advances to step S57.

In step S57, the driving assistance controller 10 determines the range of time the assisted vehicle may pass through the intersection ("the passage time range") using the turn-on time of each aspect in the signal indication information of the main-side traffic signal. The passage time range is set to start from the nearest turn-on time of a green light and is set to end at the subsequent turn-off time of the green light. Note that in the case of an actuated traffic signal, the nearest turn-on time of a green light is the current time.

In step S57, the remaining distance calculator 14 of the driving assistance controller 10 calculates the distance the assisted vehicle has remaining to reach an intersection ahead (i.e., the remaining distance). The remaining distance is calculated by obtaining the difference between (a) current location information of vehicle 100 that is acquired by the location information acquisition part 31 (for example, latitude and longitude information) and (b) either a stop-line location or an intersection location of road shape information acquired from either the optical-beacon-communication transceiver 21 or road-to-vehicle communication transceiver 22.

Alternatively, the remaining distance calculator 14 may obtain the remaining distance to an intersection ahead by calculating the difference between (a) the location information of the intersection for which assistance information is to be provided based on map information stored in the road information storage part 32, and (b) information on the current location of vehicle 100 acquired from the location information acquisition part 31.

In step S58, the travel-speed-range calculator 15 of the driving assistance support controller 10 calculates a range of travel speed within which the assisted vehicle may pass through the intersection ahead by calculating a maximum and minimum speed in the following way. The maximum speed of the travel speed range is obtained by dividing (a) the remaining distance calculated in step S57 by (b) a driving time defined as a time period from the current time to the time when the nearest passage time range begins for the intersection ahead. The minimum speed of the travel speed range is obtained by dividing (a) the remaining distance calculated in step S57 by (b) a driving time defined as a time period from the current time to the time when the nearest passage time range ends for the intersection ahead. Note that in the case of an actuated traffic signal, since the nearest turn-on time for a green light is the current time that makes the calculated maximum speed become infinity, the maximum speed is set to a speed limit.

In step S59, the driving assistance controller 10 determines whether or not the minimum speed of the travel speed range for the intersection ahead that is calculated in step S58 is equal to or lower than the speed limit of road 90 (i.e., the legally-assigned maximum speed limit).

If the minimum speed is greater than the speed limit ("No" in S59), the assisted vehicle cannot pass through road 90 without stopping at a red light. The process advances to step S61.

In step S61, the driving assistance controller 10 outputs red-light assistance information by controlling the display 51 and audio output 52 via the red-light assistance information output part 17. As red-light assistance information, driving assistance information is provided to give guidance on coming to a stop at the intersection stop line. For example, the red-light assistance information output part 17 may use a dashboard display to advise the driver to reduce acceleration or release the accelerator. Alternatively, the audio output 52 may be used for voice guidance.

The process then returns to step S52, and the driving assistance controller 10 repeats the steps from S52 to S61 at a predetermined time interval until the assisted vehicle stops at the stop line of the intersection ahead.

If, in step S59, the minimum speed is equal to or below the speed limit ("Yes" in S59), then it is possible for the assisted vehicle to travel along road 90 and pass through the intersection without stopping for a red light as long as the assisted vehicle remains within the travel speed range that is equal to or below the speed limit. The process therefore advances to step S60.

In step S60, the driving assistance controller 10 outputs proceed-through-signal assistance information via the proceed-through-signal assistance information output part 16. As proceed-through-signal assistance information, the range of speed at which the assisted vehicle may pass through the intersection is provided. For example, the proceed-through-signal assistance information output part 16 may use a dashboard display to show the assisted vehicle's recommended speed range from the minimum speed to maximum speed (the maximum speed to be shown is replaced by a speed limit if the maximum speed exceeds the speed limit). Alternatively, the audio output 52 may be used for voice guidance.

In the case of actuated traffic signals, in step S58, travel speed is calculated by dividing the remaining distance by the driving time defined as a time period from the current time to the turn-off time of a red light (i.e., when the traffic signal returns to a green light). If the calculated travel speed is greater than the vehicular speed of the assisted vehicle, then the assisted vehicle will reach the intersection after the main-side traffic signal has returned to a green light, and maintaining of the current vehicular speed may be the proceed-through-signal assistance information that is output.

After step S60 is completed, the driving assistance controller 10 returns to step S52, and repeats the steps from S52 to S61 at a predetermined time interval until the assisted vehicle passes through the intersection ahead.

The driving assistance controller 10 periodically repeats the process of outputting driving assistance information for subsequent intersections within the scope of information that is acquired in step S51.

When there is congestion at an intersection, an assisted vehicle will be unable to travel within the recommended speed range. To cater to such circumstances, the driving assistance controller 10 may, when going through the process shown in FIG. 5, assess whether or not the assisted vehicle is travelling within the recommended speed range (that is output in step S60) using the vehicular speed measured with the vehicular speed sensor 41. If the assisted vehicle has not been travelling within the recommended speed range for a specific length of time, the driving assistance controller 10 may terminate the outputting of proceed-through-signal assistance information. By doing so, reliability of the proceed-through-signal assistance information as perceived by the driver can be improved.

Alternatively, the driving assistance controller 10 may, via an optical-beacon-communication transceiver 21 or a road-to-vehicle communication transceiver 22, obtain information on congestion of the road for which road signal information is acquired. For congested intersections, the driving assistance controller 10 may choose not to output driving assistance information based on road signal information.

Next, the process of the driving assistance controller 10 when the assisted vehicle is travelling on an intersecting road (i.e., an intersecting-side vehicle) is explained with FIG. 6.

In step S62, the remaining distance calculator 14 of the driving assistance controller 10 calculates a remaining distance to the intersection ahead by obtaining the difference between (a) current location information of the assisted vehicle that is acquired by the location information acquisition part 31 (for example, latitude and longitude information) and (b) road shape information on either a stop-line location or an intersection location acquired from the road-to-vehicle communication transceiver 22.

Furthermore, in step S62, the driving assistance controller 10 acquires the current vehicular speed via the vehicular speed sensor 41.

In step S63, the red-light assistance information output part 17 of the driving assistance controller 10 outputs red-light assistance information via the display 51 and audio output 52. As red-light assistance information, guidance to come to a stop at the intersection' stop line is provided, based on the remaining distance to the intersection and vehicular speed. For example, the red-light assistance information output part 17 may use the display 51, such as a dashboard display, to advise the driver to reduce acceleration or release the accelerator. Alternatively, the audio output 52 may be used to provide voice guidance on deceleration.

Then, in step S64, the driving assistance controller 10 notifies either of the following information to the roadside unit 83 as an intersecting-side vehicle: (a) information on the remaining distance to the intersection and vehicular speed, or (b) an arrival time to the intersection. This notification is made via the road-to-vehicle communication transceiver 22. The arrival time to the intersection is equivalent to the stopping time when the assisted vehicle comes to a stop at the stop line in accord with the red-light assistance information derived in step S63.

This notified information from the intersecting-side vehicle becomes the information on the activation state of actuated traffic signals (hereinafter "activation information of actuated traffic signals") on which step S55's decision is based.

Once step S64 is complete, the driving assistance controller 10 returns to step S52, and repeats the steps from S52 to S64 at a predetermined time interval until the assisted vehicle comes to a stop at the intersection ahead.

Figure 7A:
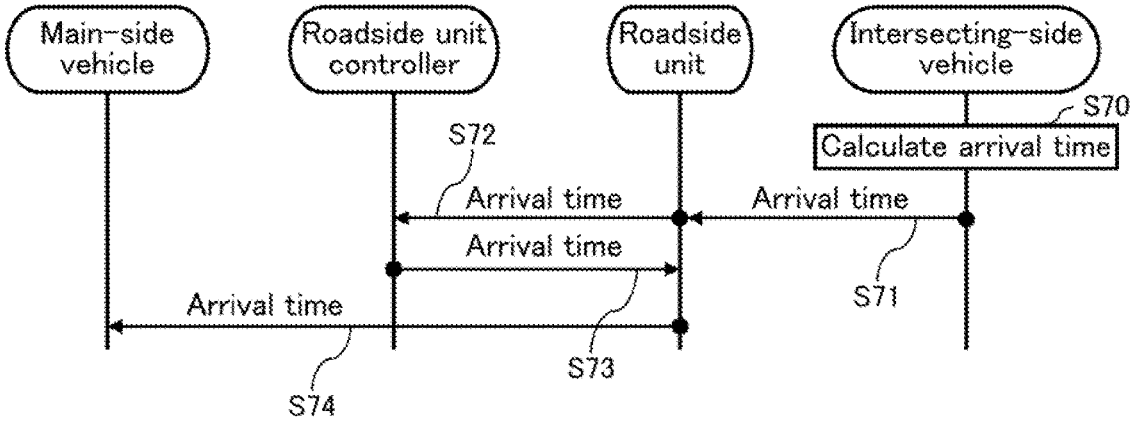
FIG. 7A is a diagram illustrating a case where an arrival time is delivered.
Figure 7B:
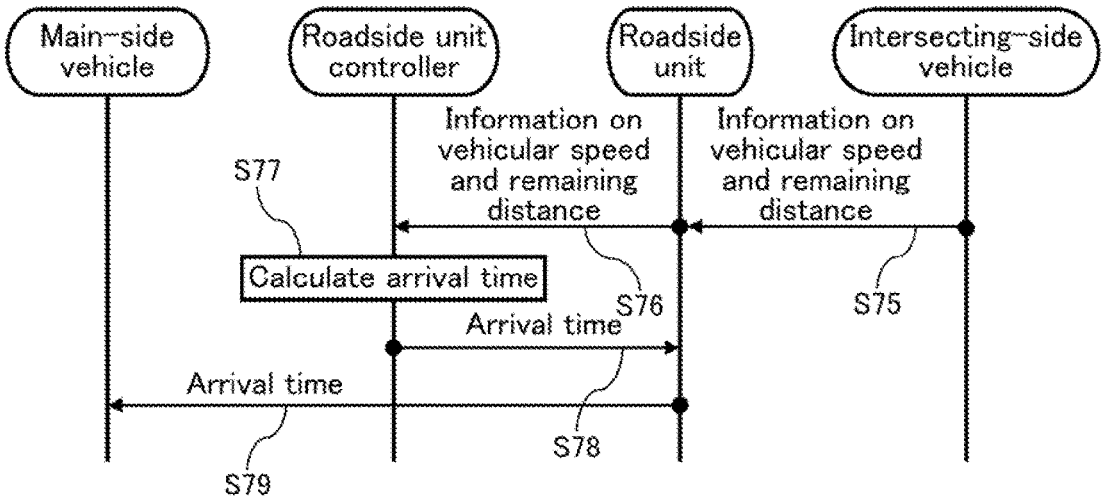
FIG. 7B is a diagram illustrating a case where an arrival time is calculated and delivered by a roadside unit controller.
Figure 7C:
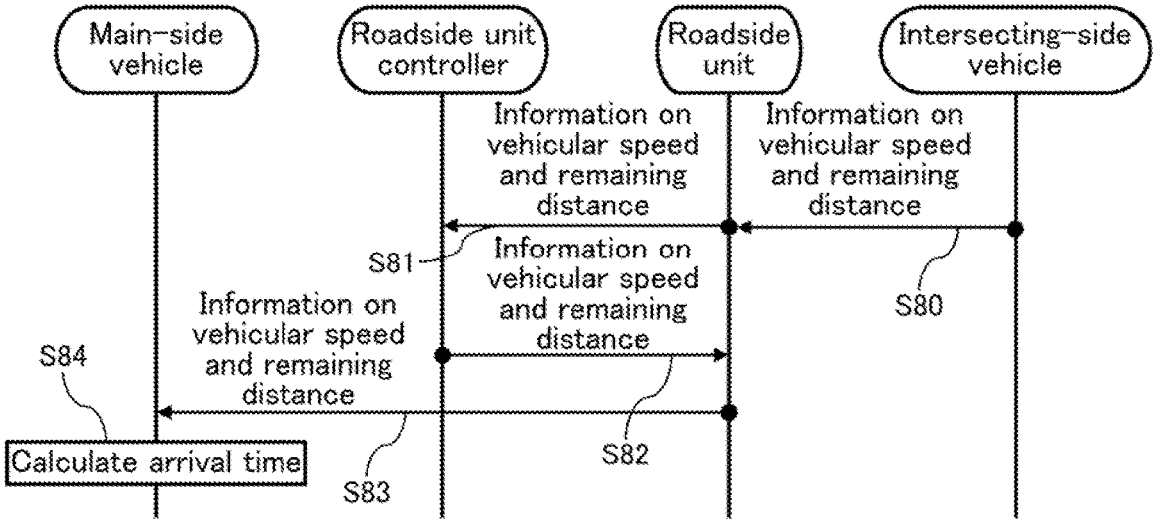
FIG. 7C is a diagram illustrating a case where a vehicular speed and remaining distance are delivered.

The method of delivering information that is notified from an intersecting-side vehicle to a main-side vehicle as activation information of actuated traffic signals (explained in the explanations of step S55 of FIG. 5 and step S64 of FIG. 6) is explained using FIG. 7A, 7B, and 7C. Notified information may be the intersecting-side vehicle's arrival time at the intersection, information on the vehicular speed and remaining distance of the intersecting-side vehicle, or signal indication information of an intersecting-side traffic signal.

FIG. 7A shows a case where the intersecting-side vehicle referred to in FIG. 6 delivers the arrival time thereof to the main-side vehicle. The intersecting-side vehicle derives the arrival time by calculating the time taken to come to a stop at the intersection stop line based on vehicular speed and remaining distance to the intersection of the intersecting-side vehicle.

To elaborate, the intersecting-side vehicle calculates the arrival time (S70) and notifies the calculated arrival time to the roadside unit controller 85 via a roadside unit 83 (S71, S72). The roadside-unit-communication part 851 of the roadside unit controller 85 acquires the arrival time from the roadside unit 83 (S72), then the control information delivery part 854 of the roadside unit controller 85 sends the arrival time to the main-side vehicle via the roadside unit 83 (S73, S74).

As described above, the roadside unit controller 85 carries out road-to-vehicle communication with the intersecting-side vehicle and main-side vehicle via the roadside unit 83 in order to forward the arrival time that serves as activation information of actuated traffic signals.

Alternatively, the transfer of the arrival time that serves as activation information of actuated traffic signals may be carried out based on vehicle-to-vehicle communication between the intersecting-side vehicle and main-side vehicle.

Alternatively, signal indication information that indicates a turn-on time of a green light on the intersecting-side traffic signal may be notified instead of the arrival time (where the turn-on time of a green light is the arrival time of the intersecting-side vehicle delayed by prescribed time [the activation period]).

FIG. 7B shows a case where information is delivered through the following sequence of steps: (a) the intersecting-side vehicle explained in FIG. 6 notifies the roadside unit controller 85 of the vehicular speed and remaining distance to the intersection of the intersecting-side vehicle; (b) the roadside unit controller 85 calculates the arrival time of the intersecting-side vehicle at the intersection based on the vehicular speed and remaining distance to the intersection of the intersecting-side vehicle; and (c) the roadside unit controller 85 delivers the calculated arrival time to the main-side vehicle.

To elaborate, the intersecting-side vehicle notifies the roadside unit controller 85 of the intersecting-side vehicle's information on vehicular speed and remaining distance to the intersection via the roadside unit 83 (S75, S76).

The roadside-unit-communication part 851 of the roadside unit controller 85 acquires the information on vehicular speed and remaining distance from the roadside unit 83 (S76), from which the arrival time when the intersecting-side vehicle arrives at the intersection is calculated (S77). The control information delivery part 854 of the roadside unit controller 85 then delivers the arrival time to the main-side vehicle via the roadside unit 83 (S78, S79).

In the case described above, the roadside unit controller 85 carries out road-to-vehicle communication with an intersecting-side vehicle via the roadside unit 83 to acquire the intersecting-side vehicle's information on vehicular speed and remaining distance (S75, S76), and calculates the arrival time of the intersecting-side vehicle at the intersection. The roadside unit controller 85 then carries out road-to-vehicle communication with the main-side vehicle via the roadside unit 83 to deliver the arrival time that serves as activation information of actuated traffic signals (S78, S79).

Alternatively, signal indication information that indicates a turn-on time of a green light on the intersecting-side traffic signal may be notified instead of the arrival time (where the turn-on time of a green light is the arrival time of the intersecting-side vehicle delayed by prescribed time [the activation period]).

FIG. 7C shows a case where information is delivered through the following sequence of steps: (a) the intersecting-side vehicle explained in FIG. 6 notifies the roadside unit controller 85 of the vehicular speed and remaining distance to the intersection of the intersecting-side vehicle; (b) the roadside unit controller 85 delivers the information on vehicular speed and remaining distance to the main-side vehicle. The main-side vehicle then calculates the arrival time of the intersecting-side vehicle at the intersection based on the information on vehicular speed and remaining distance.

To elaborate, the intersecting-side vehicle's information on vehicular speed and remaining distance to the intersection is notified to the roadside unit controller 85 via the roadside unit 83 (S80, S81).

The roadside-unit-communication part 851 of the roadside unit controller 85 acquires the information on vehicular speed and remaining distance from the roadside unit 83 (S81), and the control information delivery part 854 of the roadside unit controller 85 delivers the information on the vehicular speed and remaining distance to the main-side vehicle via the roadside unit 83 (S82, S83).

As mentioned in the explanation for step S56, the main-side vehicle calculates the arrival time of the intersecting-side vehicle at the intersection from the acquired vehicular speed and remaining distance (S84).

In the case described above, the roadside unit controller 85 carries out road-to-vehicle communication with the intersecting-side vehicle and main-side vehicle via the roadside unit 83 to deliver the intersecting-side vehicle's information on vehicular speed and remaining distance that serves as activation information of actuated traffic signals (S80, S81, S82, S83).

Alternatively, the intersecting-side vehicle and main-side vehicle may carry out vehicle-to-vehicle communication to transfer the intersecting-side vehicle's information on vehicular speed and remaining distance that serves as activation information of actuated traffic signals.

By acquiring the activation information of actuated traffic signals based on any of the above delivery methods, the vehicle driving assistance device 1 of the embodiment may provide assistance to an assisted vehicle for passing through an intersection with actuated traffic signals, even when the assisted vehicle is travelling on a main road.

It therefore becomes possible for the vehicle driving assistance device 1 of the embodiment to obtain the lighting information of actuated traffic signals before a change to the signal indication information of the actuated traffic signals is made based on a detection signal coming from a vehicle detector 68. The vehicle driving assistance device 1 of the embodiment therefore avoids causing a sudden change in the driving assistance information.

There is a traffic rule known as the "turn on red" rule that allows a vehicle to make a right turn (for right hand traffic) after stopping at a signalized intersection while the traffic signal is indicating a red light.

At intersections where actuated traffic signals are installed and where a "turn on red" rule applies on an intersecting road of the intersection (hereinafter a "TOR-type intersection"), situations can occur where the main-side traffic signal turns from a green light to a red light after an intersecting-side vehicle has turned right, causing disruption on main road traffic. Not only that, but the driving assistance information of a main-side vehicle gets changed as well, which may be distracting to a driver.

The vehicle driving assistance device 1 of the embodiment may stop the activation process of actuated traffic signals at an intersection depending on the location of a main-side vehicle travelling towards the intersection. This way, the driving assistance information does not change for the main-side vehicle because the signal indication information does not change.

Figure 8:
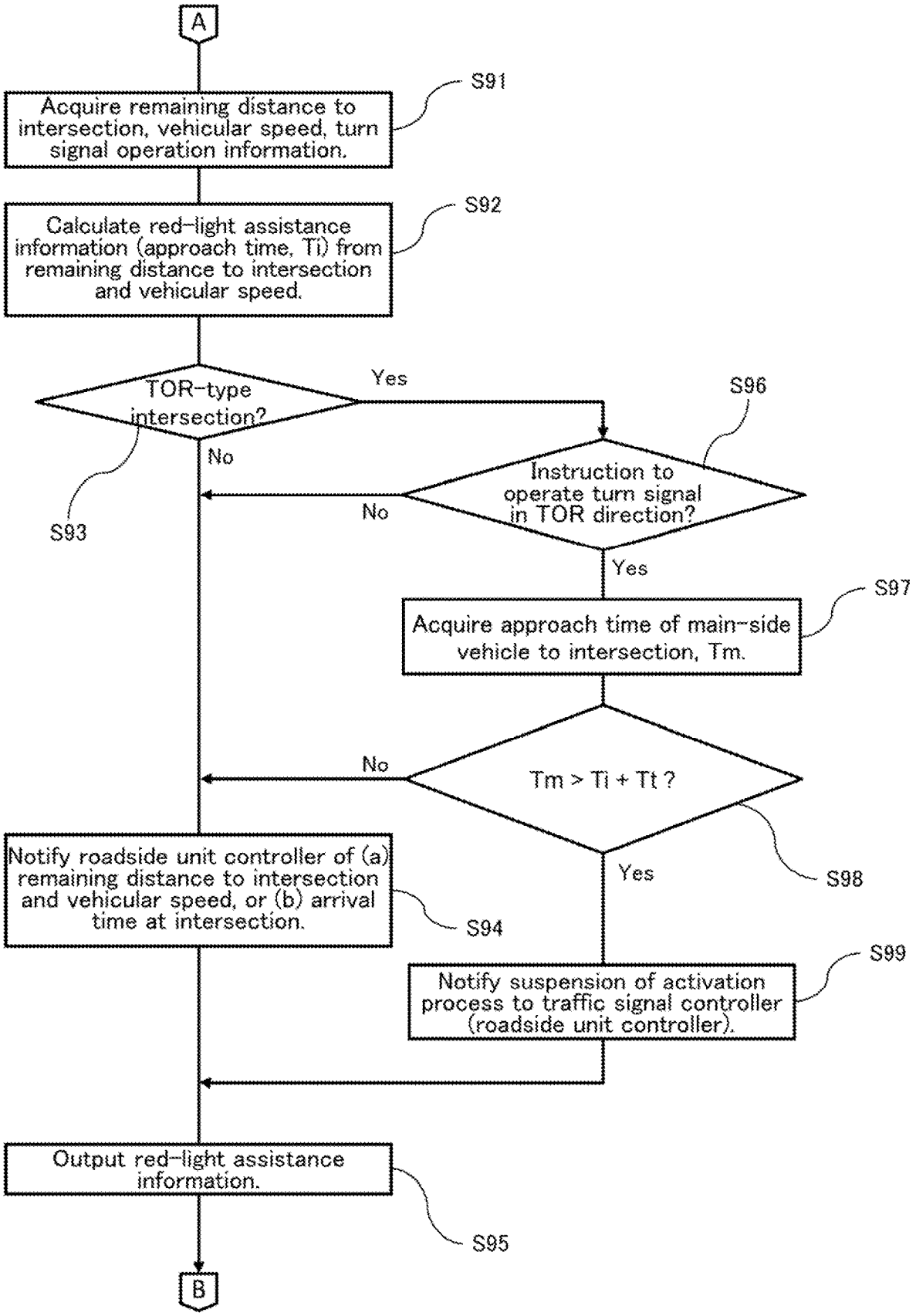
FIG. 8 is a flow chart of a processes performed by a driving assistance controller adapted to a TOR-type intersection.

FIG. 8 is a flow chart of the process of the driving assistance controller 10 for an intersecting-side vehicle (the assisted vehicle). The process shown in FIG. 8 replaces the process shown in FIG. 6.

In step 91, the remaining distance calculator 14 of the driving assistance controller 10 calculates the remaining distance of the assisted vehicle to the intersection ahead. The remaining distance is calculated by deriving the difference between (a) current location information of vehicle 101 that is acquired by the location information acquisition part 31 (for example, latitude and longitude information), and (b) road shape information on either the stop line location or the intersection location that was acquired by the road-to-vehicle communication transceiver 22.

While still in step 91, the driving assistance controller 10 acquires the current vehicular speed based on the vehicular speed sensor 41.

Furthermore, the driving assistance controller 10 acquires information on the turn-signal operation instruction indicating the instructed direction of turn shown by a turn signal, via the turn-signal operation detector 42.

In step S92, approach time (Ti) is derived in either of the following two ways: (a) by deriving the time taken to come to a stop at a stop line based on a vehicular speed and remaining distance to the intersection using the lighting time calculator 13, or (b) by using the approach time obtained in the course of outputting red-light assistance information.

In step S93, the driving assistance controller 10 determines whether or not the intersection is a TOR-type intersection, an intersection where the "turn on red" rule applies. To elaborate, the decision is made based on information such as road-shape information and map information. If the intersection is a TOR-type intersection ("Yes" in S93), the process advances to step S96. If not ("No" in S93), the process advances to step S94.

In step S96, the driving assistance controller 10 determines whether or not the information on the turn-signal operation instruction indicates an instructed direction of turn by a turn signal that coincides with the direction in which a vehicle may turn on a red light based on the "turn on red" rule (hereinafter a "TOR direction").

In step 97, the driving assistance controller 10 acquires the approach time of a main-side vehicle to reach the intersection (the approach time of a main-side vehicle, Tm).

To elaborate, the driving assistance controller 10 requests the roadside unit controller 85 (via the roadside unit 83) for the approach time to the intersection of a main-side vehicle closest to the intersection. The roadside unit controller 85 acquires the approach time from the main-side vehicle via the roadside unit 83 and notifies the information to the driving assistance controller 10 of the intersecting-side vehicle.

Note that the main-side vehicle's vehicular speed and remaining distance may be acquired instead of the main-side vehicle's approach time, in which case the driving assistance controller 10 calculates the main-side vehicle's approach time.

In step S98, the driving assistance controller 10 compares the main-side vehicle's approach time to the intersection (Tm) with the sum of the intersecting-side vehicle's approach time to an intersection (Ti) and the time taken for the intersecting-side vehicle to pass through the intersection (Tt). If Tm is greater than the sum of Ti and Tt ("Yes" in step S98), then the process advances to step S99, and if not ("No" in step S98), to step S94.

In step S99, the driving assistance controller 10 sends a notification via road-to-vehicle communication to the roadside unit controller 85 instructing the suspension of the activation process of traffic signals 64*a*, 64*b*, and 64*d* for a given period of time.

The roadside unit controller 85 controls the traffic signal controller 67 to invalidate, for a specific period, the detection of a vehicle stopping at a stop line by the vehicle detector 68.

The process then advances to step S95.

Because the activation process of the actuated traffic signals does not take place when a vehicle intending to turn in the TOR direction approaches the intersection, driving assistance information provided to the main-side vehicle is not affected. If, after the given period of time, an intersecting-side vehicle at the stop line is still unable to pass through the intersection, then the activation process is set in motion so that the intersecting-side traffic signal changes to a green light (and the main-side traffic signal changes to a red light), enabling the intersecting-side vehicle to pass through.

In step S94, the driving assistance controller 10 notifies either of the following information to be referenced as activation information of actuated traffic signals to the roadside unit 83 via the road-to-vehicle communication transceiver 22: (a) information on the vehicular speed and remaining distance to the intersection; or (b) the stopping time when the assisted vehicle comes to a stop at the stop line in accordance with the red-light assistance information (arrival time at the intersection).

In step S95, the driving assistance controller 10 uses the red-light assistance information output part 17 to control the display 51 and audio output 52 to output driving assistance information in the form of red-light assistance information that guides a driver of the assisted vehicle to come to a halt at the intersection's stop line. For example, the red-light assistance information output part 17 outputs voice guidance via the audio output 52, or displays advice to reduce acceleration or to release the accelerator on the display 51 (such as a dashboard display).

In this way, even at intersections with actuated traffic signals where the "turn on red" rule applies, traffic proceeding through the intersection on the main road does not get disrupted needlessly. Not only that, but a driver of a main-side vehicle does not experience a sudden change in driving assistance information.

The above descriptions regarding the embodiment adapted to the "turn on red" rule are provided with respect to right-hand traffic by way of example only. The embodiment and teachings herein are also applicable to left-hand traffic. One skilled in the art will, in light of the present disclosures, be able to apply the teachings provided herein for left-hand traffic.

Finally, numerous modifications and variations of the present invention are possible in light of the above teachings. It is therefore to be understood that within the scope of the appended claims, the invention may be practiced otherwise than as specifically described herein.

What is claimed is:

1. A vehicle driving assistance device for outputting information that assists an assisted vehicle to pass through an intersection installed with actuated traffic signals, the vehicle driving assistance device comprising:

a driving assistance controller which comprises a processor serving as a signal information acquisition part, a remaining distance calculator, and a driving assistance information output portion; and an acquisition portion comprising a receiver, wherein the processor serves as the signal information acquisition part to acquire lighting period information of an actuated traffic signal on a main-road side of the intersection, wherein the processor serves as the remaining distance calculator to obtain a remaining distance to the intersection of the assisted vehicle, wherein the processor serves as the driving assistance information output portion to output driving assistance information derived from the lighting period information and the remaining distance, wherein the acquisition portion is configured to acquire intersecting-road side information of the intersection where a main road is joined by an intersecting road, the intersecting-road-side information being (a) information on a vehicular speed and a remaining distance to the intersection of an intersecting-side vehicle travelling towards the intersection on the intersecting road, (b) an arrival time of the intersecting-side vehicle at the intersection, or (c) lighting period information of an actuated traffic signal on an intersecting-road side of the intersection, wherein the driving assistance controller is configured to (i) update the lighting period information of the actuated traffic signal on the main-road side of the intersection based on information acquired from the acquisition portion, and (ii) output driving assistance information through the driving assistance information output portion based on the updated lighting period information.

2. A vehicle driving assistance device according to claim 1, wherein the driving assistance controller (i) is configured to calculate an arrival time of the intersecting-side vehicle at the intersection from the vehicular speed and the remaining distance to the intersection of the intersecting-side vehicle that are acquired from the acquisition portion, (ii) is configured to update the lighting period information of the actuated traffic signal on the main-road side of the intersection so that the actuated traffic signal on the main-road side changes from a green light to a red light at a time that is derived by adding an activation period to the arrival time of the intersecting-side vehicle, the activation period being a length of time taken for an actuated traffic signal of the intersection to turn from a red light to a green light, and (iii) is configured to output driving assistance information through the driving assistance information output portion.

3. A vehicle driving assistance device according to claim 1, wherein the driving assistance controller (i) is configured to update the lighting period information of the actuated traffic signal on the main-road side of the intersection so that the actuated traffic signal on the main-road side changes from a green light to a red light at a time that is derived by adding an activation period to the arrival time of the intersecting-side vehicle at the intersection that is acquired from the acquisition portion, the activation period being a length of time taken for an actuated traffic signal of the intersection to turn from a red light to a green light, and (ii) is configured to output driving assistance information through the driving assistance information output portion.

4. A vehicle driving assistance device according to claim 1, wherein the driving assistance controller (i) is configured to update the lighting period information of the actuated traffic signal on the main-road side of the intersection so as to be in agreement with the lighting period information of the actuated traffic signal on the intersecting-road side of the intersection that is acquired from the acquisition portion, (ii) is configured to output driving assistance information through the driving assistance information output portion.

5. A vehicle driving assistance device according to claim 1, wherein the acquisition portion is configured to acquire information through either (i) vehicle-to-vehicle communication with the intersecting-side vehicle, or (ii) road-to-vehicle communication with a roadside unit set up at the intersection.

6. A driving information delivery system for delivering driving information among a roadside unit that is set up at an intersection installed with actuated traffic signals, a main-side vehicle travelling on a main-road side of the intersection to cross the intersection, an intersecting-side vehicle travelling on an intersecting-road side of the intersection to cross the intersection, wherein A. the intersecting-side vehicle comprises a processor and a transceiver serving as:

(i) a remaining distance calculator, wherein the processor serves as the remaining distance calculator to obtain a remaining distance of the intersecting-side vehicle to the intersection, and (ii) a road-to-vehicle communication transceiver, the road-to-vehicle communication transceiver configured to notify a vehicular speed and the remaining distance to the roadside unit, wherein B. the roadside unit comprises a processor configured to:

(i) acquire the vehicular speed and the remaining distance of the intersecting-side vehicle, (ii) calculate an arrival time of the intersecting-side vehicle at the intersection from the vehicular speed and the remaining distance, and (iii) notify the main-side vehicle of the arrival time, and wherein C. the main-side vehicle comprises a processor and a transceiver serving as:

(i) a signal information acquisition part, wherein the processor serves as the signal information acquisition part to acquire lighting period information of an actuated traffic signal on the main-road side of the intersection, (ii) a remaining distance calculator, wherein the processor serves as the remaining distance calculator to obtain a remaining distance of the main-side vehicle to the intersection, (iii) a road-to-vehicle communication transceiver, the road-to-vehicle communication transceiver configured to acquire the arrival time of the intersecting-side vehicle at the intersection, and (iv) a driving assistance information output portion, wherein the processor serves as the driving assistance information output portion to output driving assistance information derived from (a) the remaining distance of the main-side vehicle and (b) the lighting period information that has been updated so that the actuated traffic signal on the main-road side of the intersection changes from a green light to a red light at a time that is derived by adding an activation period to the arrival time, the activation period being a length of time taken for an actuated traffic signal of the intersection to turn from a red light to a green light.

7. A driving information delivery system for delivering driving information among a roadside unit that is set up at an intersection installed with actuated traffic signals, a main-side vehicle travelling on a main-road side of the intersection to cross the intersection, an intersecting-side vehicle travelling on an intersecting-road side of the intersection to cross the intersection, wherein A. the intersecting-side vehicle comprises a processor and a transceiver serving as:

(i) a remaining distance calculator, wherein the processor serves as the remaining distance calculator to obtain a remaining distance of the intersecting-side vehicle to the intersection, and (ii) a road-to-vehicle communication transceiver, the road-to-vehicle communication transceiver configured to notify a vehicular speed and the remaining distance to the roadside unit, wherein B. the roadside unit comprises a processor configured to:

(i) acquire the vehicular speed and the remaining distance of the intersecting-side vehicle, (ii) calculate an arrival time of the intersecting-side vehicle at the intersection from the vehicular speed and the remaining distance, and (iv) notify the main-side vehicle of lighting period information of an actuated traffic signal on the intersecting-road side of the intersection, the lighting period information including a time when the actuated traffic signal on the intersecting-road side turns from a red light to a green light that is derived by adding an activation period to the arrival time, the activation period being a length of time taken for an actuated traffic signal of the intersection to turn from a red light to a green light, and wherein C. the main-side vehicle comprises a processor and a transceiver serving as:

(i) a signal information acquisition part, wherein the processor serves as the signal information acquisition part to acquire lighting period information of an actuated traffic signal on the main-road side of the intersection, (ii) a remaining distance calculator, wherein the processor serves as the remaining distance calculator to obtain a remaining distance of the main-side vehicle to the intersection, (iii) a road-to-vehicle communication transceiver, the road-to-vehicle communication transceiver configured to acquire the lighting period information of the actuated traffic signal on the intersecting-road side, and (iv) a driving assistance information output portion, wherein the processor serves as the driving assistance information output portion to output driving assistance information derived from (a) the remaining distance of the main-side vehicle and (b) the lighting period information of the actuated traffic signal on the main-road side that has been updated to be in agreement with the lighting period information of the actuated traffic signal on the intersecting-road side.

8. A driving information delivery method for delivering driving information among a roadside unit set up at an intersection installed with actuated traffic signals, a main-side vehicle travelling on a main-road side of the intersection to cross the intersection, an intersecting-side vehicle travelling on an intersecting-road side of the intersection to cross the intersection, the driving information delivery method comprising:

A. acts, by the intersecting-side vehicle, of (i) deriving a remaining distance of the intersecting-side vehicle to the intersection, and (ii) notifying a vehicular speed and the remaining distance to the roadside unit, B. acts, by the roadside unit, of (i) acquiring the vehicular speed and the remaining distance of the intersecting-side vehicle, (ii) calculating an arrival time of the intersecting-side vehicle at the intersection from the vehicular speed and the remaining distance, and (iii) notifying the main-side vehicle of lighting period information of an actuated traffic signal on the intersecting-road side of the intersection, the lighting period information comprising a time when the actuated traffic signal on the intersecting-road side turns from a red light to a green light that is derived by adding an activation period to the arrival time, the activation period being a length of time taken for an actuated traffic signal of the intersection to turn from a red light to a green light, and C. acts, by the main-side vehicle, of (i) acquiring the lighting period information of the actuated traffic signal on the intersecting-road side, (ii) deriving a remaining distance to the intersection of the main-side vehicle, and (iii) outputting driving assistance information derived from the remaining distance of the main-side vehicle and lighting period information of an actuated traffic signal on the main-road side of the intersection that has been updated to be in agreement with the lighting period information of the actuated traffic signal on the intersecting-road side.

9. A vehicle driving assistance device for outputting information that assists an assisted vehicle to pass through an intersection that is installed with actuated traffic signals and where a turn-on-red rule applies, the vehicle driving assistance device comprising:

a driving assistance controller which comprises a processor serving as a signal information acquisition part, a remaining distance calculator, and a driving assistance information output portion and a turn-signal operation detector; and a communication portion comprising a transceiver, wherein the processor serves as the signal information acquisition part to acquire lighting period information of an actuated traffic signal on a main-road side of the intersection, wherein the processor serves as the remaining distance calculator to derive a remaining distance of the assisted vehicle to the intersection, wherein the turn-signal operation detector is configured to detect an instruction to operate a turn signal for a right turn or a left turn of the assisted vehicle, wherein the processor serves as the driving assistance information output portion to output driving assistance information derived from the lighting period information and the remaining distance, wherein the communication portion is configured to communicate a vehicular speed and a remaining distance with another vehicle travelling to pass through the intersection, and wherein while the assisted vehicle is travelling on a main road, the driving assistance controller is (i) configured to calculate an arrival time at the intersection of an intersecting-side vehicle travelling on an intersecting road based on information on a vehicular speed and a remaining distance of the intersecting-side vehicle that is acquired via the communication portion, (ii) configured to update the lighting period information of the actuated traffic signal on the main-road side so that the actuated traffic signal on the main-road side changes from a green light to a red light at a time that is derived by adding an activation period to the arrival time of the intersecting-side vehicle, the activation period being a length of time taken for an actuated traffic signal of the intersection to turn from a red light to a green light, and (iii) configured to output the driving assistance information derived from remaining distance and the lighting period information of the actuated traffic signal on the main-road side through the driving assistance information output portion, and when the assisted vehicle is travelling on an intersecting road to turn at the intersection in a direction where the assisted vehicle is allowed to pass through the intersection at red light according to the turn-on-red rule, the driving assistance controller is (i) configured to calculate an arrival time at the intersection of a main-side vehicle travelling on the main road based on information on a vehicular speed and a remaining distance of the main-side vehicle that is acquired via the communication portion, and (ii) configured not to notify the main-side vehicle of a vehicular speed and the remaining distance of the assisted vehicle if the arrival time of the main-side vehicle is greater than a sum of an arrival time at the intersection of the assisted vehicle and a time taken for the assisted vehicle to cross the intersection, the sum based on the vehicular speed and the remaining distance of the assisted vehicle.

* * * * *